US006679787B2

(12) United States Patent
Unosawa

(10) Patent No.: US 6,679,787 B2
(45) Date of Patent: Jan. 20, 2004

(54) GOLF SHAFT AND GOLF CLUB HAVING THE SAME

(75) Inventor: Akira Unosawa, Saitama-ken (JP)

(73) Assignee: Mamiya-Op Co., Ltd., Saitama-ken (JP)

( * ) Notice: Subject to any disclaimer, the term of this patent is extended or adjusted under 35 U.S.C. 154(b) by 0 days.

(21) Appl. No.: 10/115,604

(22) Filed: Apr. 2, 2002

(65) Prior Publication Data

US 2003/0171159 A1 Sep. 11, 2003

(30) Foreign Application Priority Data

Mar. 11, 2002 (JP) ..... 2002-065691

(51) Int. Cl.[7] ..... A63B 53/10; A63B 53/12
(52) U.S. Cl. ..... 473/319; 473/323
(58) Field of Search ..... 428/36.3, 36.9; 264/635; 156/187, 188; 473/316–326

(56) References Cited

U.S. PATENT DOCUMENTS 5,397,636 A * 3/1995 Miyao et al. ..... 428/195
5,944,618 A * 8/1999 Cheng ..... 473/319
6,117,021 A * 9/2000 Crow et al. ..... 473/289

* cited by examiner

*Primary Examiner*—Stephen Blau
(74) *Attorney, Agent, or Firm*—Darby & Darby

(57) ABSTRACT

It is a subject of the invention to show excellent decorative properties of golf shafts, to maintain the decorative properties for a long time, and to improve its usability. An upper ply being transparent or at least having translucency to the extent that the interior surface is visible and a lower ply having different surface configuration from the upper ply and the surface configuration of which can be seen through the upper ply provided underneath the upper ply are provided. The lower ply and the upper ply are formed of materials having different oscillation damping rate.

21 Claims, 2 Drawing Sheets

GOLF SHAFT AND GOLF CLUB HAVING THE SAME

BACKGROUND OF THE INVENTION

1. Field of the Invention

The present invention relates to a golf shaft and a golf club.

2. Description of the Related Art

Existing mainstream golf club shafts include a carbon shaft and a steel shaft, and the users make a choice depending on their own physical capacities or characteristics and performances of material.

In recent years, the users tend to attach importance to decorative properties in addition to performances or characteristics when choosing a golf club.

Heretofore, those shafts had plain color, that is, the carbon shaft was black which was a self-color of carbon fiber, and the steel shaft was silver (metallic) obtained by plating process. However, in recent years, golf shafts decorated with various colors or patterns on the surfaces thereof by paint application or by metal coating process are increasing.

However, in the case of decorations on the surfaces of shafts by paint application or by metal coating process described above, when they are scratched or peeled off, they are not functional any more from an decorative point of view, and designs are limited anyway because they are two-dimensional decorations.

For example, the amateur golfers tend to choose the steel shaft that is used by so called leading professional golf players.

However, since the steel shaft is heavy in comparison with the carbon shaft, and thus the amateur golfers cannot handle the steel shaft skillfully, in many cases they use a carbon shaft that looks like a steel shaft by being painted or by being metal coated. However, as described above, the base can be exposed due to scratches or peeling, and thus the decorative effect to make it look as a steel shaft may be lost.

Differences of the characteristics between carbon shafts and steel shafts include, for example, a difference of oscillation damping rate.

In general, since oscillation damping rate of carbon shafts is high, the impact exerted at the time of meeting the ball is suppressed by bending of the shaft. However, there is a case where the shaft which is bent during the downswing cannot be maintained in its bent state and is restored to the original state during the course of downswing before the impact, whereby the golfer cannot take advantage of the head speed.

In contrast to it, since the oscillation damping rate of the steel shaft is low, the impact exerted at the time of meeting the ball is significant, and thus it might put a heavier physical burden on the golfer. However, bending of the shaft during downswing can be maintained and thus the golfer can take sufficient advantage of the head speed at the impact.

In other words, the carbon shaft and the steel shaft have completely opposite advantages and disadvantages with respect to each other due to the difference of characteristics as described above. Professional golfers or skilled amateur golfers can make use of advantages or these two types of shafts and make full use of their performances, while general amateur golfers can hardly make use of their advantages, but are subject to the disadvantages in many cases.

SUMMARY OF THE INVENTION

Accordingly, it is a subject of the invention to show excellent decorative properties of golf shafts as well as to maintain the same for a long time, and thus an object of the invention is to provide a golf shaft and a golf club in which the aforementioned subject is solved.

In addition to the aforementioned subjects, it is another subject to improve its usability, and thus another object of the invention is to provide a golf shaft and a golf club in which another subject is solved.

In order to achieve the objects, the invention employs the following technical measures.

A technical measure of the invention is to provide a golf shaft comprising an upper ply being transparent or at least having translucency to the extent that the interior surface is visible and a lower ply provided underneath the upper ply so that the surface configuration can be seen through the upper ply. (claim 1)

Another technical measure of the invention is to provide a golf shaft comprising an upper ply being transparent or at least having translucency to the extent that the interior surface is visible and a lower ply having a surface pattern being different from that of the upper ply provided underneath the upper ply so that the surface pattern can be seen through the upper ply. (claim 2)

In order to achieve another object of the invention, the invention employs the following technical measure.

The technical measure is a golf shaft comprising an upper ply being transparent or at least having translucency to the extent that the interior surface is visible and a lower ply having a surface pattern being different from that of the upper ply provided underneath the upper ply so that the surface pattern can be seen through the upper ply, characterized in that the upper ply and the lower ply are formed of materials having the different vibration characteristics from each other. (claim 3)

The factors to determine the vibration characteristics of material include, for example, specific gravity, rigidity, hardness, and oscillation damping rate.

Material being transparent or at least having translucency to the extent that the interior surface is visible includes glass fiber pre-preg, epoxy resin, phenol resin, thermosetting resin such as unsaturated polyester.

The term "transparent" used here means the extent that the internal surface can be clearly viewed including colorless transparent and colored transparent, and the term "translucency" used here means colored state to the extent that at least the internal surface can be viewed mistily.

When employing colored transparency, preferably, glass fiber pre-preg resin or thermosetting resin is colored in advance so that the entire thickness of the upper ply is colored, thereby preventing the color of the upper ply from being diminished.

By providing the lower ply with a substantially solid configuration which is different from that of the upper ply the substantially solid configuration can be seen through the upper ply (claim 4 and claim 6), and decoration having depth and spatial effect appears on the golf shaft.

The substantially solid configurations includes, for example, a rough configuration, a stepped configuration, and a polygonal configuration. When employing such solid configurations, the member to be used for the lower ply is formed into the exemplified configurations, or a separate member is adhered on the surface of the member to form it into a solid configuration.

In the case of adhering a separate member, various patterns including characters, graphics, patterns, and so on can be employed, and thus freedom of decoration can be expanded very much.

Alternatively, two-dimensional decoration such as characters, graphics, or patterns can also be employed optionally on the surface of the lower ply having a substantially solid configuration. With such arrangement, decoration on the lower ply is protected by the upper ply, and thus decoration on the lower ply is prevented from being diminished.

The upper ply includes a colorless transparent ply or a colored transparent ply on the surface thereof (claim 7 and claim 9), and such transparent ply is preferably a thin coated ply of transparent coating material applied thereon or of thermosetting resin, which serves to protect the ply immediately underneath thereof.

Preferably, the transparent ply is colorless transparent for example when the ply immediately underneath thereof is colorless transparent, colored transparent, or translucent, and is colored transparent in the same color when the ply immediately underneath thereof is colored transparent.

In terms of material having different oscillation damping rate, when the upper ply is formed of glass fiber pre-preg, or of thermosetting resin, the lower ply may be of metal material or carbon fiber pre-preg.

When metal material is employed, the surface of the metal material is preferably protected from rust by rustproof plating, metal film coating, or painting, which prevents the formation of rust on the lower ply and separation between the upper ply and the lower ply or deterioration of decorative property due to rust.

In addition, the surface of the metal material is preferably processed to increase adhesiveness with respect to thermosetting resin (including glass fiber pre-preg resin) used in the upper ply, which may prevent separation between the upper ply and the lower ply.

This process includes, for example, surface roughening of the metal material and plating process or metal evaporation process by the use of a metal that increases adhesiveness.

In the case where glass fiber pre-preg is used for the upper ply, surface roughening is preferably made so that the direction of roughness of on the rough surface coincides with the direction of the fiber of glass fiber pre-preg.

Metal to be used for plating process exemplified here includes zinc, nickel, aluminum, iron-based or copper-based metal.

In the case where carbon fiber is used for the lower ply, metal evaporation process may be made on the surface thereof in order to make metal color decoration to make the shaft look like a steel shaft.

In the case where the upper ply is formed by winding multiple layers of ply of glass fiber pre-preg, preferably, fibers of the pre-preg are laid in the same direction in order to ensure see-through of the upper ply.

In this case, preferably, adhesive ply is interposed between the upper ply and the lower ply at the ends of the shaft on the head side and on the grip side, which are susceptible to separation of glass fiber pre-preg, within the ranges that do not impair decorations on the surface of shaft. This adhesive ply achieves enhancement of the separation preventing effect of rough surface, as well as prevention of separation that often happens when cutting the ends of the shaft during molding of the shaft.

The adhesive ply used here is preferably thermosetting resin or glass fiber pre-preg impregnated with the same resin, for example glass fiber pre-preg impregnated with borax-based modified epoxy resin (ex. "KS1020/P-162" manufactured by Toho Tenax Co.,Ltd.).

When employing this pre-preg for the adhesive ply, it is formed by laying glass fibers in the bias direction, polymerizing them in the cross-linked state, and winding around the lower ply.

When the upper ply and the lower ply are formed of materials having different oscillation damping rates, the following effects are expected.

Taking a shaft in which the lower ply is made of steel and the upper ply is made of glass fiber pre-preg as an example, since the lower ply formed of steel is low in oscillation damping rate and the upper ply of glass fiber pre-preg has an oscillation damping rate higher than the lower ply, this shaft has such characteristics that the lower ply serves to maintain bending of the shaft generated during the downswing to sufficiently take advantage of the head speed at the impact, and the upper ply serves to help the restoring action of the lower ply to accelerate the restoring speed for absorbing the impact at the time of meeting the ball, so that the physical burden to the golfer is alleviated.

Therefore, by employing a golf shaft described in claim 1 to claim 9 of the invention in a golf club (claim 10 to claim 18), a golf club which is quite favorable in appearance and in usability is obtained.

DESCRIPTION OF THE PREFERRED EMBODIMENTS

Figure 1:
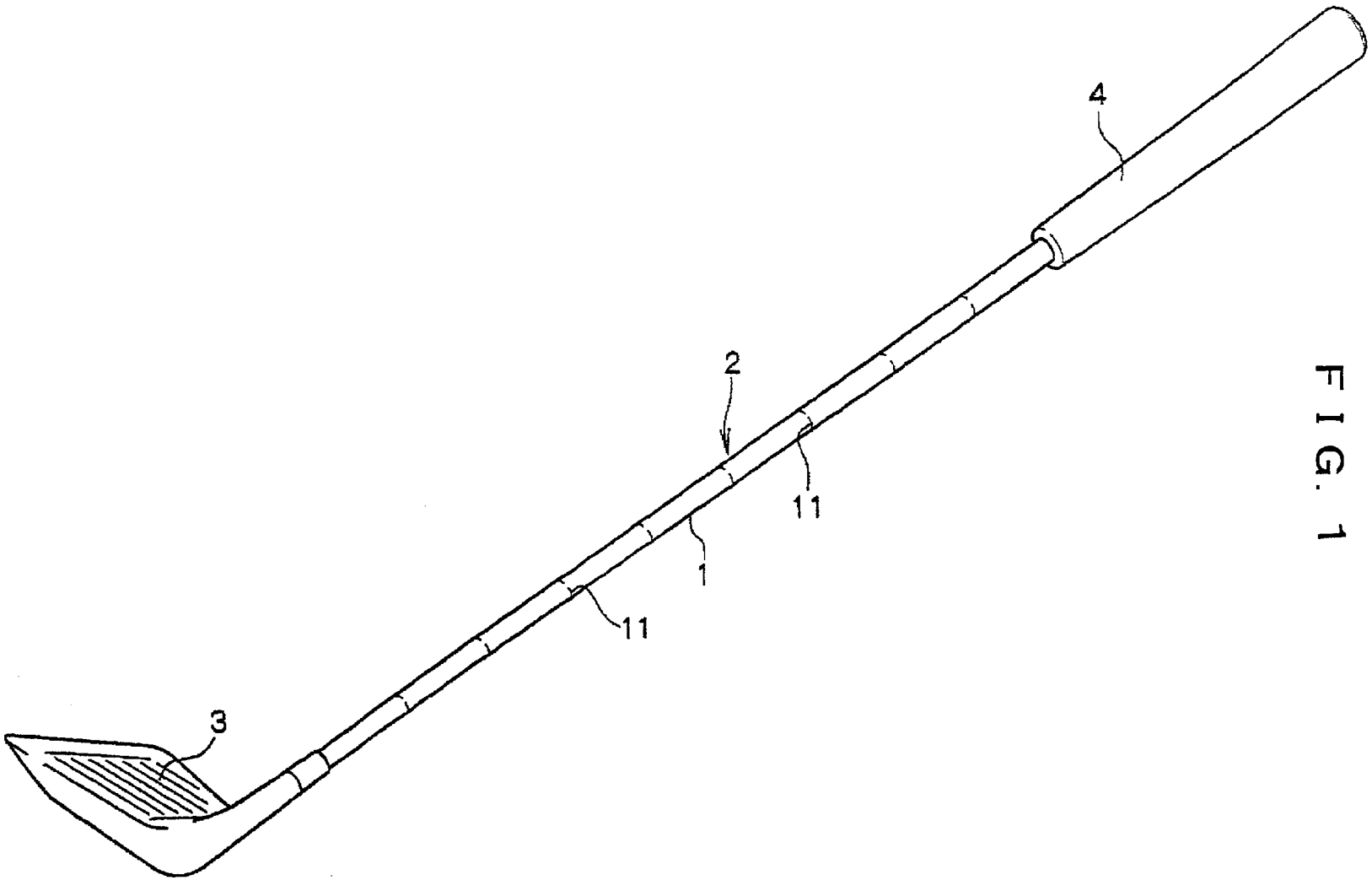
FIG. 1 shows a golf club according to the invention.

Referring now to the drawings, an embodiment of the present invention will be descried.

FIG. 1 shows a golf club 2 provided with a golf shaft 1 according to the invention, in which decoration 11 having depth and spatial effect can be viewed from the surface of the golf shaft 1.

The golf club 2 is provided with a golf shaft 1 that can sufficiently take advantage of the head speed and alleviate the physical burden to the golfer in addition to decoration described above.

The reference numeral 3 designates a head and the numeral 4 designates a grip.

The construction of the golf shaft 1 provided in the golf club 2 will be described in detail below.

Figure 2A:
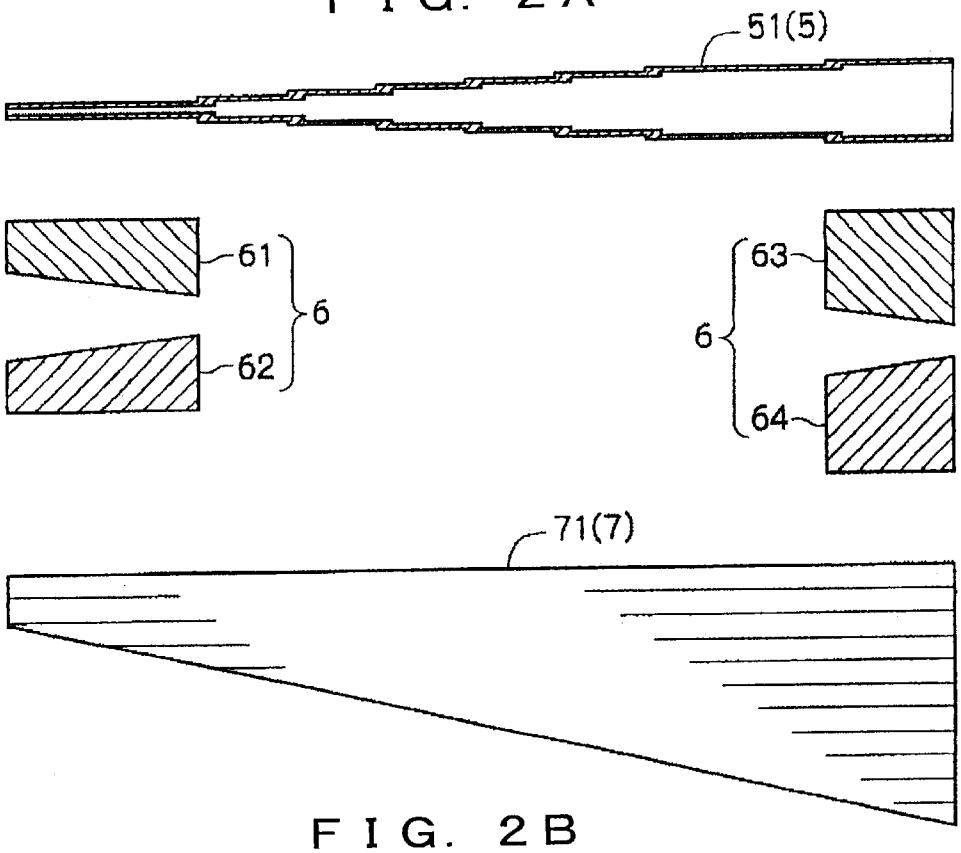
FIGS. 2A–2D are explanatory drawings showing a construction and a molding method of golf shaft provided in a golf club.

The golf shaft 1 comprises a metal shaft 51 constructing the lower ply 5, pre-pregs 61, 62, 63, 64 constituting an adhesive ply 6, and a glass fiber pre-preg 71 constituting an upper ply 7 as shown in FIG. 2A.

The metal shaft or central member 51 is formed with a multistage configuration to provide a three dimensional surface, which is then covered with a rustproof coating.

The pre-pregs 61, 62, 63, 64 are glass fiber pre-pregs impregnated with borax-based modified epoxy resin. The pre-pregs 61, 62 are formed by laying glass fibers respectively in the opposite bias directions and polymerizing in the cross-linked state. The pre-pregs 63, 64 are also formed in the same manner.

The pre-pregs 61, 62 are formed in the same length as the thinnest portion of the metal shaft 51 including the end on the side of the head 3, and the pre-pregs 63, 64 are formed in the same length as the thickest portion of the metal shaft 51 including the end on the side of the grip 4.

Glass fiber pre-preg 71 is formed by laying the fibers in the straight direction, providing the same length as the whole length of the metal shaft 51, and the width as wide as it can be wound several turns on the metal shaft 51.

Figure 2B:
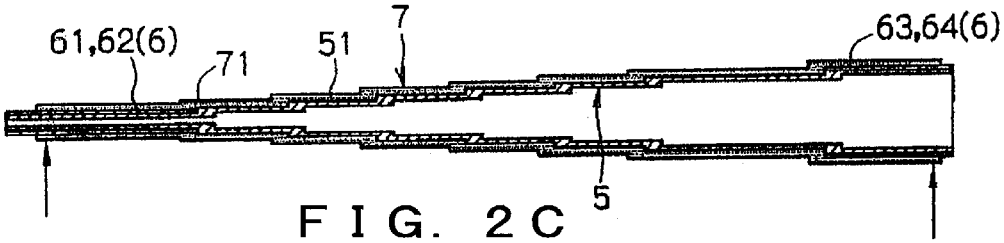

The golf shaft 1 is molded using the aforementioned members by the steps of winding the pre-pregs 61, 62 on the thinnest portion of the metal shaft 51, winding the pre-pregs 63, 64 on the thickest portion of the metal shaft 51, winding glass fiber pre-preg 71 on thus prepared metal shaft 51 so as not to produce any gap therebetween, sintering the same, and cutting (the position shown by the arrow) into the prescribed length (FIG. 2B).

Figure 2C:
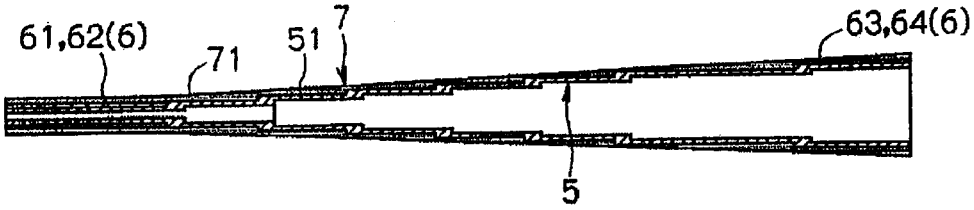

The steps formed on the surface is polished into a flat surface, and transparent paint is applied thereon to finish (FIG. 2c).

Figure 2D:
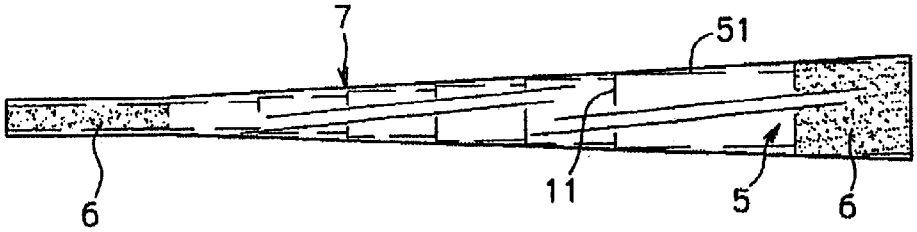

Accordingly, the surface and the three-dimensional configuration formed on the surface of the metal shaft 51 on the lower ply 5 can be seen through the upper ply 7, whereby the golf shaft 1 with decoration 11 having depth and spatial effect is molded (FIG. 2D).

When the adhesive ply 6 having aforementioned construction is employed, the adhesive ply 6 (shown in a satin finished pattern) appears on the surface of the upper ply 7. Therefore, though a part of the adhesive ply 6 may be seen through after it is assembled into the golf club 2, it may be used as a part of the pattern.

By assembling the head 3 and the grip 4 on the golf shaft 1 thus molded, the golf club 2 shown in FIG. 1 is obtained.

Though the upper ply is formed of glass fiber pre-preg in this embodiment, when the upper ply is formed of thermosetting resin, it can be molded by applying heat and pressure in a die, and thus polishing process can be omitted.

When the lower ply is formed of carbon fiber pre-preg instead of metal, the golf shaft with decorations having depth and spatial effect can be molded by the steps of winding carbon fiber pre-preg on the mandrel, adhering a separate member that constitutes a three-dimensional configuration thereon, winding glass fiber pre-preg directly on thereon, and then sintering and polishing the same.

The method of adhering the separate member with three-dimensional pattern can be employed for the metal shaft.

As is described thus far, the invention has the following advantages.

According to the invention, since the surface configuration of the lower ply that differs from that of the upper ply can be seen through the upper ply, excellent decoration appears on the surface of the golf shaft, and in addition, the decoration can be prevented from being diminished.

Therefore, a golf shaft in which the subjects described above, that is, to show excellent decorative properties of golf shafts as well as to maintain the same for a long time are solved is provided.

Since the upper ply and the lower ply have different oscillation damping rates from each other, it can sufficiently take advantage of the head speed and alleviate the physical burden to the golfer in addition to the decorative effect.

Therefore, a golf shaft in which another subject, that is, to improve the usability in addition to the decorative effect is solved is provided.

In addition, since the three-dimensional configuration can be seen through the upper ply by providing a substantially three-dimensional configuration on the surface of the lower ply, excellent decoration having depth and spatial effect appears on the golf shaft.

Since the upper ply includes a colorless transparent ply or a colored transparent ply on its surface, the transparent ply can protect the ply located immediately underneath the transparent ply.

Since the golf club is provided with a golf shaft with aforementioned excellent effects, it is quite favorable in decorative properties as well as in usability.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A golf shaft having a central support member, comprising an upper ply being transparent or at least having translucency to the extent that an interior surface is visible and the central support member having a surface pattern being different from that of the upper ply provided underneath the upper ply due to polishing the upper ply so that the surface pattern can be seen through the upper ply.

2. A golf shaft according to claim 1, wherein said central support member is provided with surface configurations, characterized in that the surface configuration of the central support member is a substantially three-dimensional configuration.

3. A golf club comprising a golf shaft according to claim 2.

4. A golf shaft according to claim 1, characterized in that the upper ply includes a colorless transparent ply or a colored transparent ply on the surface thereof.

5. A golf club comprising a golf shaft according to claim 4.

6. A golf club comprising a golf shaft according to claim 1.

7. A golf shaft according to claim 2, in which said central support member is fabricated from metal.

8. A golf shaft according to claim 7, in which said central support member is fabricated from steel.

9. A golf shaft as in claim 8, in which said central member comprises a plurality of metal sections of increasing diameter from the bottom to the top of the shaft, and an adhesive ply between said upper ply and said central member.

10. A golf shaft as in claim 9, wherein said adhesive ply comprises two sections, one of said sections being positioned between the smallest diameter metal section and said upper ply, and the other of said adhesive ply sections being positioned between the largest diameter metal section and said upper ply.

11. A golf club comprising a golf shaft according to claim 10.

12. A golf shaft according to claim 2, in which said central support member is fabricated from carbon.

13. A golf shaft as in claim 2, and an adhesive ply between said upper ply and said central member.

14. A golf shaft as in claim 13, in which said adhesive ply comprises two sections, one section being located adjacent one end of said shaft and the second section being located adjacent the other end of said shaft.

15. A golf club comprising a golf shaft according to claim 14.

16. A golf shaft having a central support member, comprising an upper ply being transparent or at least having translucency to the extent that an interior surface is visible and the central support member having a surface pattern being different from that of the upper ply provided underneath the upper ply due to polishing the upper ply so that the surface pattern can be seen through the upper ply, characterized in that the upper ply and the central support member are formed of materials having different vibration characteristics from each other.

17. A golf shaft according to claim 3, wherein said central support member is provided with surface configuration characterized in that the surface configuration of the central support member is a substantially three-dimensional configuration.

18. A golf club comprising a golf shaft according to claim 6.

19. A golf shaft according to claim 3, characterized in that the upper ply includes a colorless transparent ply or a colored transparent ply on the surface thereof.

20. A golf club comprising a golf shaft according to claim 9.

21. A golf club comprising a golf shaft according to claim 3.

* * * * *